United States Patent [19]

Kanada

[11] Patent Number: 4,910,560

[45] Date of Patent: Mar. 20, 1990

[54] CLEANING DEVICE FOR USE IN COPYING MACHINE

[75] Inventor: Tomohisa Kanada, Osaka, Japan

[73] Assignee: Minolta Camera Kabushiki Kaisha, Osaka, Japan

[21] Appl. No.: 163,102

[22] Filed: Mar. 2, 1988

[30] Foreign Application Priority Data

Mar. 5, 1987 [JP] Japan ..... 62-51093
Mar. 5, 1987 [JP] Japan ..... 62-51094
Mar. 5, 1987 [JP] Japan ..... 62-32259[U]

[51] Int. Cl.[4] ..... G03G 21/00

[52] U.S. Cl. ..... 355/299; 118/652; 15/256.5

[58] Field of Search ..... 355/3 R, 15; 15/256.5, 15/256.51; 118/652

[56] References Cited

U.S. PATENT DOCUMENTS 3,510,903 5/1970 Stoever ..... 15/256.5
4,014,065 5/1977 Hudson ..... 35/15 X
4,666,282 5/1987 Rowe ..... 355/15 X

FOREIGN PATENT DOCUMENTS 55-35345 3/1980 Japan .
57-124852 8/1982 Japan .

*Primary Examiner*—R. L. Moses
*Attorney, Agent, or Firm*—Wenderoth, Lind & Ponack

[57] ABSTRACT

A cleaning device is provided with a blade adapted to contact the peripheral surface of a photosensitive drum and wipe residual toner off of the photosensitive drum. A duct is disposed separately from the blade, and is adapted to remove the toner wiped off by the blade by air suction. In the interval between the blade and the duct, there is disposed a sealing member which serves to prevent ambient air from entering the duct through the interval. This sealing member is fixed either on a stationary region of a holder for the blade or on the basal end part of the blade integrated with the holder or on the outer surface of the duct, and contacts the duct if mounted on the holder or the blade, or contacts the blade or holder if mounted on the duct.

10 Claims, 6 Drawing Sheets

CLEANING DEVICE FOR USE IN COPYING MACHINE

BACKGROUND OF THE INVENTION

1. Field of the Invention:

This invention relates to a cleaning device to be incorporated in a copying machine or printer for effecting removal of toner from a photosensitive drum after the work of transfer and more particularly to a cleaning device provided with a cleaning blade adapted to contact the peripheral surface of the photosensitive drum.

2. Description of the Prior Art:

In the operation of an electrophotographic machine, after a toner image developed on a photosensitive drum is transferred onto a copy paper, part of the toner remains on the peripheral surface of the photosensitive drum. For the removal of the remaining toner from the peripheral surface of the photosensitive drum, therefore, the electrophotographic machine requires to the incorporation therein of a cleaning device.

Japanese Patent Application Disclosure SHO 55(1980)-35,345 discloses a cleaning device which comprises a hood having an opening opposed to a photosensitive drum and serving to effect suction of residual toner. A blade is fixed in the hood and adapted to contact the peripheral surface of the photosensitive drum and wipe the residual toner off of the peripheral surface. The hood is provided at a leading end thereof with a sealing member which remains in contact with the peripheral surface of the photosensitive drum while suction is suspended, and which remains out of contact with the peripheral surface to admit ambient air into the hood while suction is in process.

Japanese Utility Model Application Disclosure SHO 57(1982)-124,852 discloses a cleaning device which comprises a duct having an opening opposed to a photosensitive drum and serving to effect suction of residual toner. A blade is fixed outside the duct and is adapted to contact the peripheral surface of the photosensitive drum to wipe the residual toner off of the peripheral surface. For the purpose of sealing the blade and the duct, the cleaning device is provided therebetween with a sealing member. When the photosensitive drum is rotated and the blade held in contact therewith vibrated sympathetically to the rotation, the vibration is inevitably transmitted to the sealing member, as a result sealing member affects the pressure of contact exerted by the blade on the photosensitive drum.

OBJECTS OF THE INVENTION

A main object of the present invention is to provide a cleaning device which comprises a blade adapted to contact the peripheral surface of a photosensitive drum and effect removal of residual toner remaining on the photosensitive drum after a transfer operation, a duct disposed separately from the blade and adapted to effect suction of the toner scraped off by the blade, and a sealing member for sealing the interval between the blade and the duct without affecting the contact pressure exerted by the blade on the peripheral surface of the photosensitive drum.

Another object of the present invention is to provide a cleaning device so constructed that when a blade is moved to a set position where the edge of the blade contacts the photosensitive drum from a retracted position where the edge is apart from the photosensitive drum, the blade oscillates while following the peripheral surface of the photosensitive drum cause the edge of the blade as a whole to contact the peripheral surface of the photosensitive drum throughout the entire axial length thereof without being affected by the sealing member serving to seal the interval between the blade and the duct.

A further object of the present invention is to provide a cleaning device which comprises a stationary region formed of a basal end part of a blade serving to wipe residual toner off a photosensitive drum and a holder integrated with the basal part of the blade so as to support the blade, a duct disposed apart from the blade and adapted to effect suction of the toner wiped off by the blade, and a sealing member interposed between the stationary region and the duct and adapted to seal the interval between the duct and the blade.

Yet another object of the present invention is to provide a cleaning device which comprises a blade serving to wipe residual toner off of a photosensitive drum, a duct disposed apart from the blade and adapted to effect suction of the toner wiped off by the blade, and a sealing member of a thin flexible sheet having a stationary side lateral part attached to one of the pair of the blade and the duct and a free side lateral part adapted to be brought into contact with the other of the pair of the blade and the duct by the current of air flowing into the duct so as to seal the interval between the blade and the duct.

SUMMARY OF THE INVENTION

In accordance with the present invention there is provided a cleaning device provided with a blade adapted to contact the surface of a photosensitive medium and wipe residual toner off of the surface of the photosensitive medium. The cleaning device has a holder integrated at a basal end thereof with the blade, and is adapted to hold the blade in position. The holder is supported at a set position enabling the leading edge of the blade to come into contact with the surface of the photosensitive medium. A suction device includes a duct having an opening positioned forward of the blade relative to the direction of travel of the photosensitive medium, and is adapted to remove the toner wiped off by the blade. A sealing member is fixed either on a stationary region of the holder, on the basal end part of the blade integrated with the holder, or on the outer surface of the duct, and adapted to seal the interval between the blade and holder and the duct.

Further in accordance with the present invention, there is having a cleaning device provided a blade adapted to contact the surface of a photosensitive medium and wipe residual toner off of the surface of the photosensitive medium. The cleaning device includes a holder integrated at a basal end part thereof with the blade, and is adapted to hold the blade in position. The holder is supported at a set position causing the leading edge of the blade to come into contact with the surface of the photosensitive medium. A suction device has a duct having an opening positioned forward of the blade relative to the direction of travel of the photosensitive medium, and is adapted to remove the toner wiped off by the blade. A sealing member formed of a thin flexible sheet material has a stationary end part fixed on either the blade or the duct and a free end part adapted to separated from either the duct or the blade, respectively, while said suction device is inoperative and to contact the duct or the blade while the suction device operates.

DESCRIPTION OF THE PREFERRED EMBODIMENTS

Figure 1:
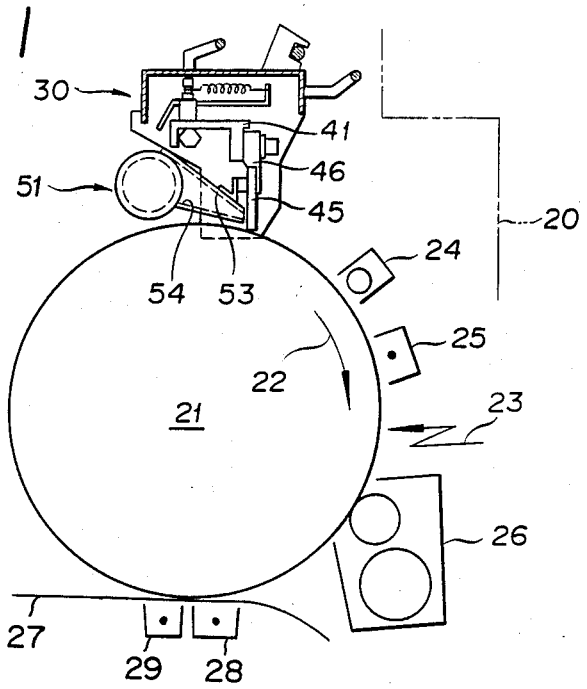
FIG. 1 is a side view illustrating an image producing part of a copying machine incorporating therein a cleaning device of the present invention.

FIG. 1 is a diagram illustrating a cleaning device of this invention incorporated in a copying machine. Inside a housing 20 of the copying machine proper, a photosensitive drum 21 is attached so as to be freely rotated clockwise in the relative position illustrated in FIG. 1 as shown by an arrow 22. Around the photosensitive drum 21 there are disposed elements of a well-known image-forming portion, which serve to transfer onto a copy paper a toner image formed from the image of a given original document on the peripheral surface of the photosensitive drum 21. An eraser 24 removes the residual charge remaining on the peripheral surface of the photosensitive drum 21 after a previous transfer operation, thereby preparing the photosensitive drum 21 for the next transfer operation. The eraser 24 is disposed in the proximity of the photosensitive drum 21. Behind the eraser 24, relative to the direction in which the photosensitive drum 21 is rotated, is disposed an electric charger 25 serving to effect uniform charging of the surface of the photosensitive drum. Behind the electric charger 25, relative to the direction in which the photosensitive drum 21 is rotated, is provided a developing unit 26 for developing toner on the electrostatic latent image. The electrostatic latent image is formed on the peripheral surface of the photosensitive drum 21 by an exposing light 23 emanating from a known image-forming optical system (not shown). Behind the developing unit 26 are disposed a transfer charger 28 for electrically transferring the toner to copying paper forwarded by a carrier guide 27 and a separating charger 29 for separating the copying paper from the photosensitive drum 21. The eraser 24 and other elements described above constitute the components of the image-forming portion.

Forward of the eraser 24, relative to the direction in which the photosensitive drum 21 is rotated, a cleaning device 30 of the present invention is disposed in the proximity of the photosensitive drum 21 so as to effect removal of the toner remaining on the peripheral surface of the photosensitive drum 21 during the course of the transfer to the copying paper by the transfer charger 28.

Figure 2:
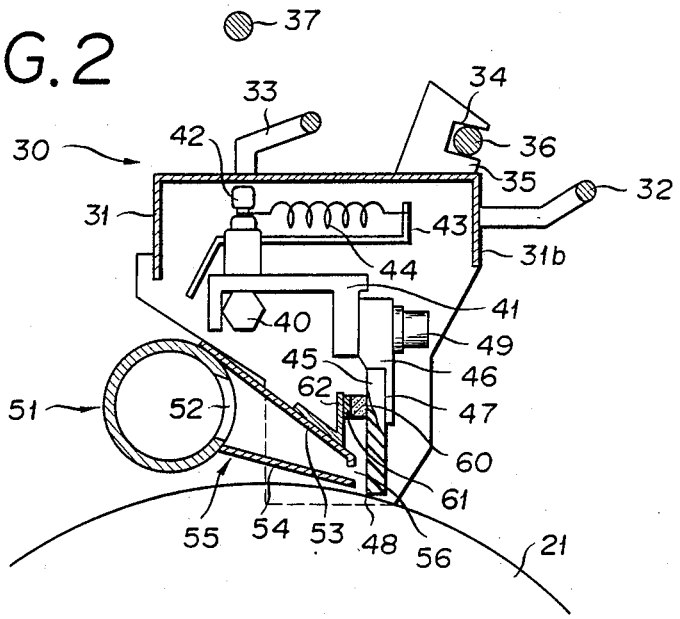
FIG. 2 is a partially cutaway side view illustrating the cleaning device of FIG. 1 as held in the set position.
Figure 3:
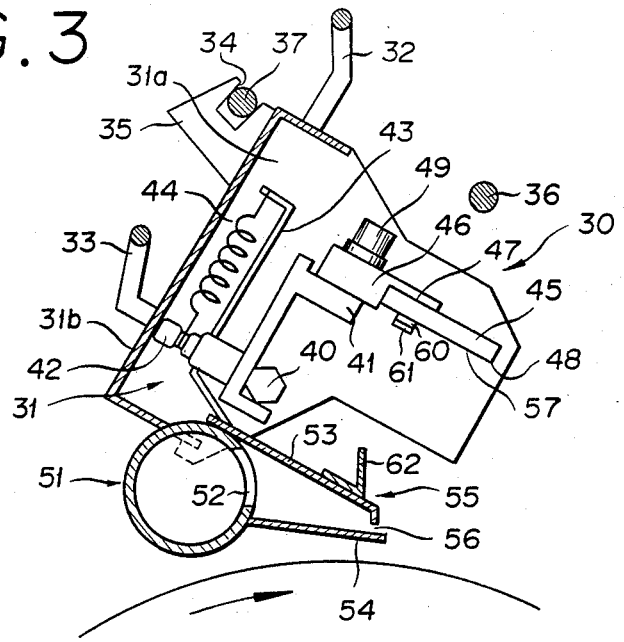
FIG. 3 is a partially cutaway side view illustrating the cleaning device of FIG. 1 as held in the retracted position.

As illustrated in FIG. 2 and FIG. 3 which show in detail the cleaning device 30 illustrated in FIG. 1, the cleaning device 30 is provided with a rotary base 31 rotatably mounted to the housing 20, the rotary base 31 being provided with an end plate 31*a* and a cover 31*b*. This rotary base 31 is rotated between a set position shown in FIG. 2 and a retracted position shown in FIG. 3. An operating handle 32 is fixed on the front part of the rotary base 31 and another operating handle 33 is fixed on the upper part thereof. Further, the rotary base 31 is provided on its upper side with a claw member 35 having an engaging groove 34. The rotary base 31 is made to occupy the set position as illustrated in FIG. 2 when a pin 36 attached to the housing 20 is meshed with the engaging groove 34 of the claw member 35. The rotary base 31 is made to occupy the retracted position as illustrated in FIG. 3 when another pin 37 attached to the housing 20 is meshed with the engaging groove 34 of the claw member 35.

A supporting base 41 is rotatably fitted on the rotary base 31 by a supporting shaft 40 fitted on the rotary base 31. An extension coil spring 44 is mounted between a projection 42 fixed on the upper side of the supporting base 41 and a bracket 43 fixed on the rotary base 31. The spring 44 imparts a resilient force on the supporting base 41 in the clockwise direction in the position of FIG. 2.

On the front side of the supporting base 41 is attached a holder 46 which is provided with a blade 45 adapted to wipe residual toner off of the peripheral surface of the photosensitive drum 21. This blade 45 is formed of an elastically deformable plate material, such as polyurethane rubber. As is clearly noted from FIG. 5, the blade 45 has a length corresponding to the length in the axial direction of the photosensitive drum 21. The holder 46 is formed of metal or rigid resin. On the leading end part of the holder 46 is formed a stepped part 47 having a smaller wall thickness than a basal end part of the holder. The basal end part of the blade 45 is fastened to the stepped part 47, as with adhesive agent.

Figure 4:
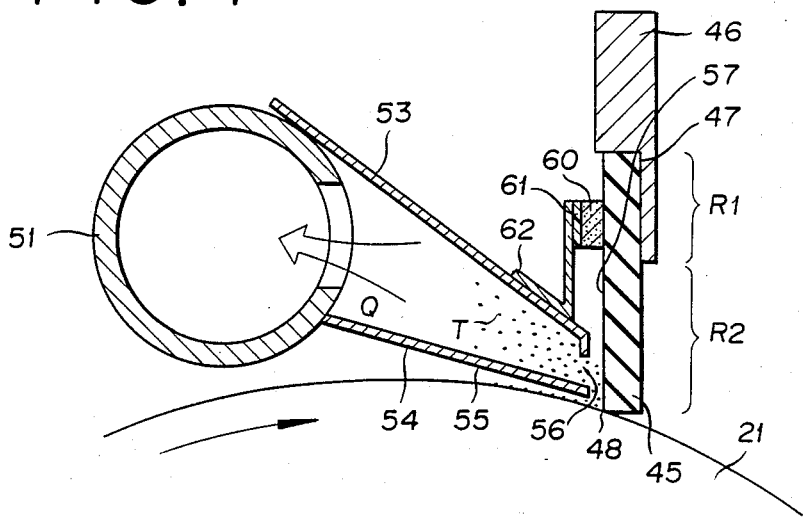
FIG. 4 is an enlarged cross section illustrating the essential part of the cleaning device of FIG. 2.

When the rotary base 31 occupies the set position shown in FIG. 2, an edge 48 of the blade 45 impinges on the peripheral surface of the photosensitive drum 21 with a predetermined pressure and wipes off the residual toner T, as illustrated in FIG. 4 When the photosensitive drum 21 is rotated with the edge 48 held in contact with the peripheral surface of the photosensitive drum 21, the leading end of the blade 45 protruding from the holder 46 is in an oscillation region R2 in which it vibrates, bends, or deforms. In contrast, the basal end of the blade 45, which is integrated with the stepped part 47, is in a stationary region R1 in which no vibration is generated. The holder 46 itself constitutes a stationary region which, similar to the stationary region R1 mentioned above, refrains from vibrating even when the leading end of the blade 45 or the oscillation region R2 is set vibrating. The stationary region constitutes a relatively rigid body, in contrast to the oscillation region, which is elastically deformable.

Figure 5:
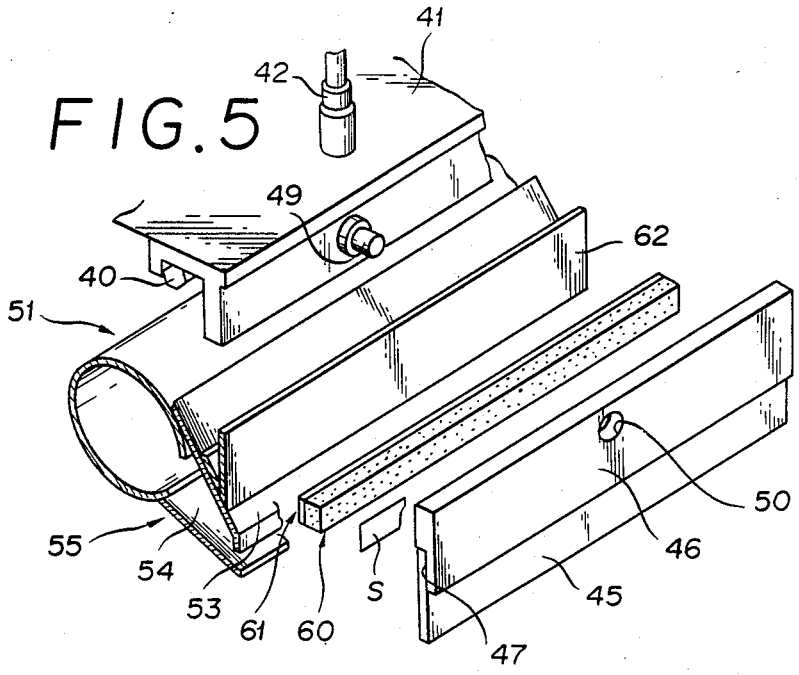
FIG. 5 is an exploded perspective view of the essential parts of FIG. 4 as seen from the front side.

As illustrated in FIG. 5, a pivot 49 projects from the front side of the supporting base 41. For the holder 46 to be mounted so as to oscillate freely relative to the supporting base 41, a hole 50 large enough for the pivot 49 to be inserted therein with ample play formed at the center of the holder 46. The holder 46 is thus allowed to oscillate about the pivot 49 so that the entire length of the edge 48 is allowed to contact the peripheral surface of the photosensitive drum 21 along the axial direction thereof.

For the removal of the residual toner wiped off by the blade 45, a main duct 51 is fixed to the housing 20 at a forward position, relative to the direction of the rotation of the photosensitive drum 21, a leading end duct 55 communicates with the main duct 51 via an opening 52 formed in the main duct 51, and is formed by an upper wall 53 and a lower wall 54 fixed on the main duct. In the leading end duct 55 is formed an opening 56 opposite a rear side 57 of the blade 45. A suction pump (not shown) is connected to the main duct 51. The residual toner T is made to flow through the opening 56 into the leading end duct 55 and then into the main duct 51. By a current of air which is formed within the leading end duct 55 and the main duct 51, as shown by an arrow Q in FIG. 4. The main duct 51 and the leading end duct 55 have lengths corresponding to the blade 45, as illustrated in FIG. 5.

To ensure that ambient air will be prevented from flowing into the opening 56 and down through the leading end duct 55, and to ensure that the air surrounding the photosensitive drum 21 will flow into the opening 56, thus enabling the residual toner T to be removed from the peripheral surface of the photosensitive drum 21, a sealing member 60 is fastened to the basal part of the blade 45. The rear side 57 of the stationary region R1 received the sealing member 60 through the medium of a double-face adhesive tape or adhesive agent S (FIG. 5). On the front side of the sealing member 60 is applied a low-friction member 61 made of a polyethylene fluoride type material such as Teflon (trademark). An auxiliary plate 62, adapted to contact the low-friction member 61 when the rotary base 31 occupies the set position, is fixed on the upper wall 53 of the leading end duct 55. This auxiliary plate 62 constitutes part of the leading end duct 55. The contact established between the sealing member 60 and the auxiliary plate 62 through the medium of the low-friction member 61 prevents the air occupying the space above the upper wall 53 from flowing into the opening 56. The sealing member 60 and the auxiliary plate 62 have lengths corresponding to the blade 45.

While the blade 45 remains in the set position, the resilient force of the spring 44 and the elasticity of the leading end of the blade 45 cooperate to press the edge 48 of the blade 45 with a predetermined force against the peripheral surface of the photosensitive drum 21. While the blade 45 remains in contact with the moving photosensitive drum 21, the leading end of the blade 45 is made to deform, shake, or vibrate in the direction of separation of the blade from the photosensitive drum 21, in spite of the resilient force of the spring 44. Even when the leading end of the blade 45 or the oscillation region R2 is made to shake, deform, or vibrate, neither the basal part of the blade 45 nor the stationary region R1 can be shaken, deformed, or vibrated, because they are integrated with the holder 46. Because the sealing member 60 is fastened to the basal part of the blade 45, the vibration, for example, of the leading end part of the blade 45 is never transmitted to the sealing member 60 while the blade 45 is in the process of wiping the residual toner T off the peripheral surface of the photosensitive drum. Further, since the sealing member 60 and the auxiliary plate 62 come into mutual contact in a static state through the medium of the low-friction member 61, perfect sealing is attained by the sealing member 60.

Figure 13:
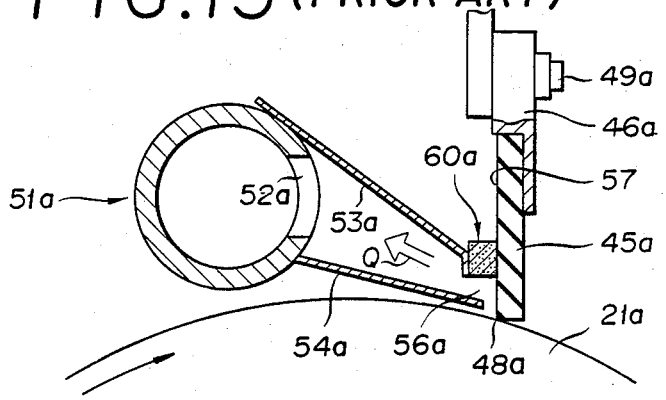
FIG. 13 (PRIOR ART)
FIG. 13 is a cross section illustrating a prior art cleaning device.

The function which the sealing member 60 of the present invention fulfills will be clearly understood by comparing the cleaning device of this invention with the conventional cleaning device (not known in the art) illustrated in FIG. 13. FIG. 13 is a diagram corresponding to FIG. 4 which illustrates the present invention. Elements of the cleaning device **30*a* illustrated in FIG. 13 similar to those illustrated in FIG. 4** are denoted by like numerals, suffixed by "a."

In the cleaning device **30*a*, as illustrated in FIG. 13, a sealing member 60*a* is fixed at the leading end of a blade 45*a*, thus being in an oscillation region. The surface of this sealing member 60*a* is held in contact with an upper wall 53*a*. The leading end of an edge 48*a* is made to vibrate, because a rotating photosensitive drum 21*a* and the blade 45*a* come into mutual contact at the edge 48*a*. Because the sealing member 60*a* is fixed at the leading end of the blade 45*a*, the vibration consequently generated is also transmitted to the sealing member 60*a*, and the sealing member 60*a* is vibrated and subjected to cushioning action. As a result, the sealing member 60*a* induces a change in the contact pressure exerted by the edge 48*a* upon the peripheral surface of the photosensitive drum 21*a***.

Further, the friction generated in the area of contact between the surface of the sealing member **60*a* and the upper wall 53*a* exerts an effect upon the proper vibration of the blade 45*a* about a pivot 49*a* and, as a result, prevents the edge 48*a* from wholly and uniformly contacting the peripheral surface of the photosensitive drum 21*a* and impedes complete removal of the residual toner. It has been found that this phenomenon tends to occur particularly when the blade 45*a*, having been kept at the retracted position with the blade apart from the photosensitive drum 21*a***, is moved to the set position.

In the case of the cleaning device 30 of the present invention illustrated in FIGS. 1 to 5, since the sealing member 60 is fixed at the area where the blade 45 is integrated with the holder 46, as described above, the vibration, oscillation, or deformation of the leading end of the blade 45 can no longer be transmitted to the sealing member 60. Thus, the otherwise possible change induced by the aforementioned cushioning action of the sealing member 60 in the contact pressure exerted by the edge 48 on the peripheral surface of the photosensitive drum 21 can be avoided. Further, since the sealing member 60 contacts the auxiliary plate 62 through the medium of the low-friction member 61, the otherwise possible uniform contact between the entire length of the edge 48 and the peripheral surface of the photosensitive drum 21 can be avoided.

Figure 6:
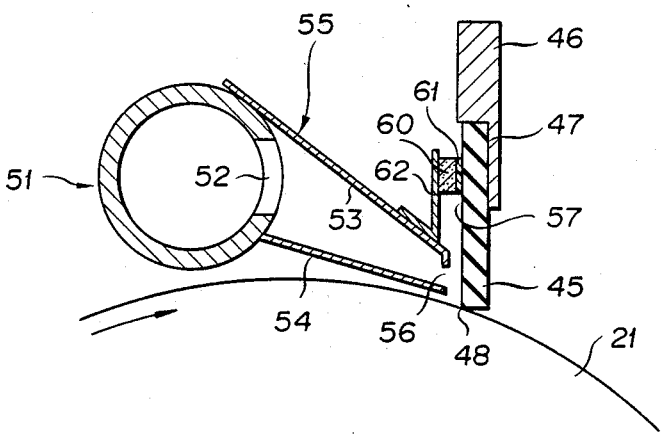
FIG. 6 is cross section illustrating the essential parts of a cleaning device of another embodiment of this invention.

FIG. 6 is a diagram illustrating a cleaning device 30 of another embodiment of present invention. In this case, the sealing member 60 is fastened to the auxiliary plate 62 through the medium of an adhesive agent or double-face adhesive tape (not shown) and auxiliary plate 62 is fixed on the upper wall 53. Sealing member 60 is made to contact the basal end of the blade 45 in the stationary region R1 through the medium of the low-friction member 61 fastened to its surface.

Figure 7:
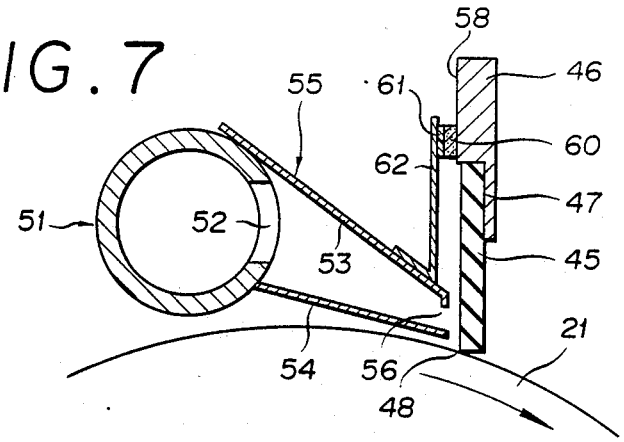
FIG. 7 is a cross section illustrating the essential parts of a cleaning device of yet another embodiment of the present invention.

FIG. 7 is a diagram illustrating a cleaning device of still another embodiment of the present invention. In this case, the sealing member 60 is fixed to the holder 46, itself constituting a stationary region similar to the basal end of the blade 45, through the medium of a double-face adhesive tape or adhesive agent (not shown). The low-friction member 61 is fastened on the surface of the sealing member 60, and is held in contact with the auxiliary plate 62. Since the holder 46 is a stationary region similar to the basal end of the blade 45, it will not vibrate, deform, or oscillate, even when the leading end of the blade 45 generates vibration. Thus, the sealing member 60 is not subjected to the aforementioned cushioning action.

Figure 8:
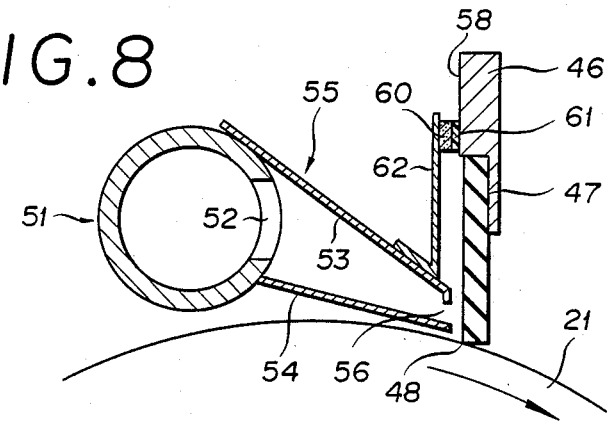
FIG. 8 is a cross section illustrating the essential parts of a cleaning device of still another embodiment of the present invention.

In the cleaning device 30 illustrated in FIG. 8, the sealing member 60 is fixed to the auxiliary plate 62 through the medium of an adhesive agent or double-face adhesive tape (not shown). The low-friction member 61 fastened to the front side of the sealing member 60 is held in with the rear side 58 of the holder 46.

Figure 9:
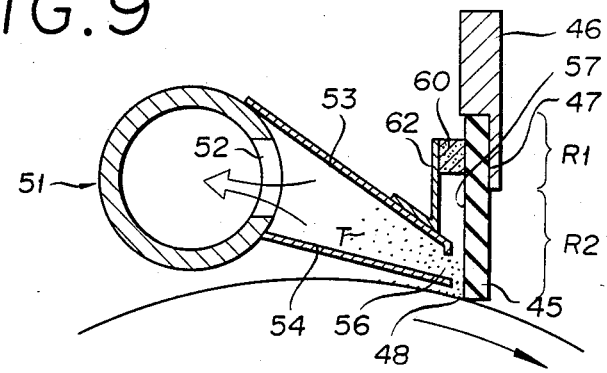
FIG. 9 is cross section illustrating the essential parts of a cleaning device of a further embodiment of the present invention.

FIG. 9 is a diagram illustrating a cleaning device of still another embodiment of this invention. The basic construction of this cleaning device 30 is similar to that of any of the cleaning devices 30 illustrated in FIGS. 1 to 5, except that the low-friction member 61 is omitted. To be specific, the sealing member 60 is fixed to the basal end of the blade 45 in the stationary region R1 through the medium of an adhesive agent or double-face adhesive tape (not shown) and the surface of the sealing member 60 is held directly in contact with the auxiliary plate 62.

Any of the cleaning devices 30 illustrated in FIG. 6, FIG. 7, and FIG. 8 may be modified so that the surface of the sealing member 60 will be held directly in contact with the basal end part of the blade 45 or the auxiliary plate 62 as illustrated in FIG. 9 to obviate use of the low-friction member 61.

Figure 10:
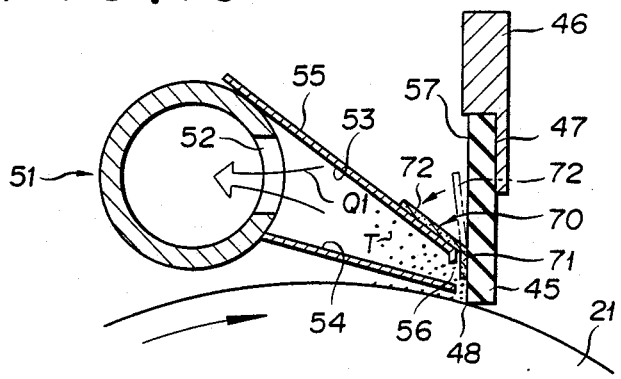
FIG. 10 is a cross section illustrating the essential parts of a cleaning device of another embodiment of the present invention, provided with a sealing member of the type different from any of the sealing members used in the cleaning devices described above.

FIG. 10 illustrates a cleaning device 30 of a further embodiment of the present invention, provided with a sealing member 70 of a type different from any of the sealing members described above. This sealing member 70 is formed of a sheet or film of an elastic material such as polyester film, and has a length corresponding to the length of the blade 45. A lateral side end part 71 of the sealing member 70 is fixed on the rear side of the leading end of the blade 45 through the medium of an adhesive agent of double-face adhesive tape. Where a current of air Q1 caused by suction is not generated, a free side end part 72 of the sealing member 70, i.e. the portion other than the lateral side end part 71, is kept raised substantially parallel to the rear side of the blade 45, as indicated by an imaginary line in FIG. 10. While the copying machine is in operation and the current of air Q1 by suction is generated, the lateral side end part 72 is caused by negative pressure to contact the upper wall 53. As a result, the interval between the upper wall 53 of the leading end duct 55 and the blade 45 is completely sealed. In this arrangement, since the sealing member 70 is fixed to the leading end of the blade 45, the portion to be shaken, a vibration caused in the leading end induces the sealing member 70 to shake. Since the lateral side end part 72 of the sealing member 70 is held in contact with the upper wall 53, which is inclined toward the rear side 57 of the blade 45, the vibration of the sealing member 70 induced by the vibration of the leading end of the blade 45 merely causes the lateral side end part 72 to slide on the upper side of the upper wall 53. As a result, the sealing member 70 is not subjected to a cushioning action compelling the edge 48 to change the contact pressure exerted thereby on the peripheral surface of the photosensitive drum 21. The blade 45, therefore, enables the edge 48 to thoroughly remove the residual toner T by exerting a fixed pressure on the peripheral surface of the photosensitive drum 21. In this case, the cleaning device has no use for the auxiliary plate 62 which forms part of the leading end duct 55 in each of the embodiments described above.

When the rotary base 31 moves from the retracted position the set position, the sealing member 70 does not allow the lateral side end part 72 to contact the upper wall 53, as indicated by an imaginary line in FIG. 10 until the current of air is generated. As a result, the blade 45 is inclined about the pivot 49. If the entire length of the edge 48 is not held in contact with the peripheral surface of the photosensitive drum 21 when moved to the set position, the blade 45 is caused to have the entire length of its edge 48 follow and contact the peripheral surface of the drum, with no friction existing between the sealing member 70 and the leading end duct 55. As a result, the creation of a uniform contact between the entire length of the edge 48 and the photosensitive drum 21 is ensured.

Figure 11:
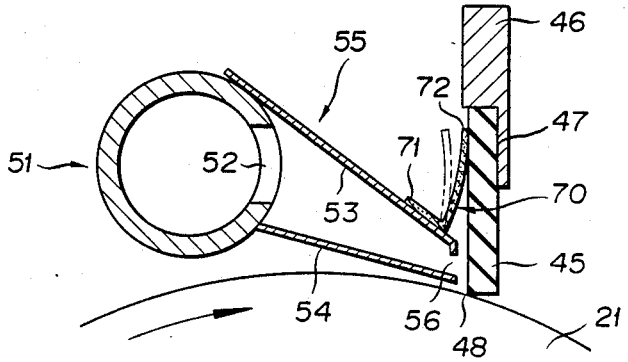
FIG. 11 is a cross section illustrating the essential parts of a cleaning device of another embodiment of this invention, provided with a sealing member of the same type as the sealing member illustrated in FIG. 10.

FIG. 11 is a diagram illustrating a typical modification of the cleaning device 30 illustrated in FIG. 10. In this case, the sealing member 70 is fixed by the lateral end part 71 thereof to the upper wall 53 of the leading end duct 55. The free side lateral end part 72 of the sealing member 70, is kept apart from the blade 45 while the current of air Q1 by suction is not being generated, as indicated by an imaginary line in FIG. 11. When the current of air Q1 is generated, the lateral end part 72 of the sealing member 70 comes into contact with the blade 45, as indicated by a solid line in FIG. 11, to completely seal the interval between the upper wall 53 and the blade 45.

Figure 12:
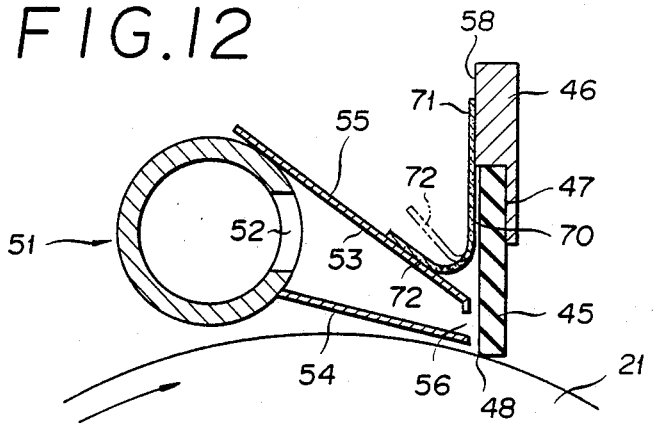
FIG. 12 is a cross section illustrating the essential part of a cleaning device of yet another embodiment of the present invention, provided with a sealing member of the same type as the sealing member illustrated in FIG. 10.

FIG. 12 is a diagram illustrating another modification of the cleaning device 30 illustrated in FIG. 10. In this case, the sealing member 70 is fixed on the rear side 58 of the holder 46 through the medium of an adhesive agent or double-face adhesive tape. This sealing member 70 is formed in a curved shape such that, while the current of air Q by suction is not generated, the lateral end part 72 thereof will remain apart from the upper wall 53, as indicated by an imaginary line in FIG. 12. When the current of air Q by suction is generated, the lateral end part 72 contacts the upper wall 53.

Optionally, the cleaning device may be modified by having the aforementioned low-friction member 61 fastened on the free side surface of the sealing member 70 illustrated in FIGS. 10 to 12, so that this free side end of the sealing member 70 will be allowed to contact some other member through the medium of the low-friction member 61.

What is claimed is:

1. A cleaning device for contacting a surface of a photosensitive medium and wiping residual toner off of said surface of said photosensitive medium, said cleaning device comprising:

a blade for contacting said surface of said photosensitive medium, said blade having a leading end portion adapted to contact said photosensitive medium to wipe off said residual toner and a basal end portion;

a holder means for rigidly holding said basal end portion of said blade;

support means for supporting said holder means at a set position whereat said leading end of said blade contacts said surface of said photosensitive medium;

suction means for removing residual toner wiped off of said photosensitive medium by said blade, said suction means including a duct having a suction opening adjacent said blade;

wherein said basal end of said blade and said holder means together form a stationary region; and sealing means for forming a seal between said duct and said stationary region to prevent ambient air from entering said duct.

2. The cleaning device as set forth in claim 1, wherein:

said suction means is selectively operable; and said sealing means is formed of a thin flexible sheet material, and includes a fixed lateral end part fixed to one of said duct and said stationary region, and a free lateral end part in contact with the other of said duct and said stationary region when said suction means is operating to form said seal and separated from the other of said duct and said stationary region when said suction means is not operating.

3. The cleaning device as set forth in claim 2, wherein said free lateral end part of said sealing means has a low-friction contact member attached thereto for contacting the other of said duct and said stationary region.

4. The cleaning device as set forth in claim 1, wherein said sealing means includes a sealing member fixed to one of said duct and said stationary region and is in contact with the other of said duct and said stationary region at said set position.

5. The cleaning device as set forth in claim 4, wherein said sealing member has a low friction member attached thereto for contacting the other of said duct and said stationary region.

6. The cleaning device as set forth in claim 1, wherein said supporting means supports said holder means so as to be movable between said set position wherein said leading end of said blade contacts said surface of said photosensitive medium and a retracted position wherein said leading end is separated from said surface.

7. A cleaning device for contacting a surface of a photosensitive medium and wiping residual toner off of said surface of said photosensitive medium, said cleaning device comprising:

a blade for contacting said surface of said photosensitive medium to wipe off said residual toner;

a holder means for holding said blade;

support means for supporting said holder means at a set position wherein said blade contacts said surface of said photosensitive medium;

a selectively operable suction means for removing residual toner wiped off of said photosensitive medium by said blade, said suction means including a duct spaced from said blade and having a suction opening adjacent said blade; and a sealing member formed of a thin flexible sheet material, said sealing member having a fixed end part fixed to one of said blade and said duct, and a free end part contacting the other of said blade and said duct when said suction means is operating and separated from the other of said blade and said duct when said suction means is not operating.

8. The cleaning device as set forth in claim 7 wherein said holder means is movably mounted on said supporting means so as to be movable between said set position wherein said blade contacts said surface of said photosensitive medium and a retracted position wherein said blade is separated from said surface.

9. The cleaning device as at forth in claim 7, wherein said free end part has a low friction contact member attached thereto for contacting the other of said duct and said blade.

10. A cleaning device for contacting a surface of a photosensitive medium and wiping residual toner off of said surface of said photosensitive medium, said cleaning device comprising:

a blade for contacting said surface of said photosensitive medium, said blade having a leading end portion adapted to contact said photosensitive medium to wipe off said residual toner and a basal end portion;

a rigid holder means rigidly holding said basal end portion of said blade, said basal end of said blade and said holder means together comprising a stationary region;

support means for supporting said holder means at a set portion whereat said leading end of said blade contacts said surface of said photosensitive medium;

suction means for removing residual toner wiped off of said photosensitive medium by said blade, said suction means including a duct having a suction opening adjacent said blade; and sealing means for forming a seal between said duct and said stationary region to prevent ambient air from entering said duct.

* * * * *